US005265895A

United States Patent [19]

Barrett

[11] Patent Number: 5,265,895

[45] Date of Patent: Nov. 30, 1993

[54] FLOOR FAN HANDTRUCK APPARATUS AND METHOD

[76] Inventor: Craig G. Barrett, 243 E. 100 North, Bountiful, Utah 84010

[21] Appl. No.: 893,979

[22] Filed: Jun. 5, 1992

[51] Int. Cl.[5] ..... B62B 1/12

[52] U.S. Cl. ..... 280/47.24; D23/383

[58] Field of Search ..... 280/47.24, 47.34, 79.3, 280/47.315; 248/158, 176; D23/370, 378, 371, 383; 416/203, 206, 182

[56] References Cited

U.S. PATENT DOCUMENTS

| | | | |
|---|---|---|---|
| 108,949 | 11/1870 | Wheeler | D23/383 |
| 2,521,920 | 9/1950 | Hoch | 280/47.24 |
| 2,693,001 | 11/1854 | Vance | 280/47.24 |
| 2,830,779 | 4/1958 | Wentling | 280/47.24 |
| 2,868,558 | 1/1959 | Krauss | 280/47.24 |
| 2,890,890 | 6/1959 | Uhlrig et al. | 280/47.24 |

*Primary Examiner*—Richard M. Camby
*Attorney, Agent, or Firm*—J. Winslow Young

[57] ABSTRACT

A floor fan handtruck wherein the external housing of the floor fan forms the framework for the floor fan handtruck. A pair of wheels are attached to the bottom surface of the floor fan. A handle is attached to the external housing. The handle also serves as a storage and transportation frame for an electrical cord and a safety cone. A hitch plate is attached to the end of the discharge chute of a first floor fan and is designed to receive a hitch pin mounted to the handle of a second floor fan to enable the operator to pull the second floor fan handtruck with the first floor fan handtruck in a trailer fashion.

11 Claims, 3 Drawing Sheets

FLOOR FAN HANDTRUCK APPARATUS AND METHOD

BACKGROUND

1. Field of the Invention

This invention relates to floor fans and, more particularly to a novel floor fan handtruck apparatus and method for incorporating a floor fan into a handtruck to facilitate transporting one or more floor fans and associated equipment from place to place.

2. The Prior Art

Floor fans are well known throughout the janitorial profession. The conventional floor fan is configured around an electrically driven, squirrel-cage blower. The electric motor for the blower is mounted in the interior space of the blower. Screen-enclosed air intakes are placed at each end of the axis of the blower. A discharge chute is located adjacent the bottom of the blower housing and extends outwardly tangentially from the blower housing and parallel to the floor. The discharge chute is designed to allow the operator to direct the blast of air from the floor fan horizontally across the designated portion of the floor. Adjustable risers at the outer end of the discharge chute allow the operator to adjust the angle of the air blast from the discharge chute relative to the floor surface.

Conventionally, a carrying handle is formed in the upper surface of the housing of the floor fan to enable the user to transport the floor fan from place to place. However, experience has shown that a floor fan is awkward and difficult to hand carry particularly for members of the janitorial profession who are less robust or even physically impaired. The result is that there are numerous instances where floor fans are not utilized even though their use would dry the floor faster resulting in the return of the floor to a safer condition more quickly. Further, I have found that the overall bulk of the floor fan causes it to be bumped by the knees of the person carrying it and that the inlet screens have been pushed into contact with the squirrel-cage blower. In view of the foregoing, it would be a significant advancement in the art to provide a cart or handtruck apparatus and method for transporting a floor fan. It would be an even further advancement in the art to incorporate the floor fan into a floor fan handtruck, the floor fan handtruck also serving as a carrier for miscellaneous accessory equipment. It would also be an advancement in the art to provide a floor fan handtruck system for a floor fan whereby a second floor fan handtruck can be releasably attached to the first floor fan handtruck to allow the operator to pull the second floor fan handtruck while pulling the first floor fan handtruck. Such a novel apparatus and method is disclosed and claimed herein.

BRIEF SUMMARY AND OBJECTS OF THE INVENTION

This invention is a novel handtruck system for a floor fan whereby the housing for the floor fan is incorporated as part of the structural framework for a handtruck. The floor fan handtruck also provides a carrier structure for the electric cord, safety cones, and the like. The floor fan handtruck includes a stair skid for allowing the floor fan handtruck to be wheeled up and down stairs. Each floor fan handtruck is fitted with a trailer hitch to allow a second floor fan handtruck to be releasably attached to the first floor fan handtruck and thereby be pulled as a trailer behind the first floor fan handtruck.

It is, therefore, a primary object of this invention to provide improvements in floor fans.

Another object of this invention is to provide improvements in the method of moving a floor fan from one place to another.

Another object of this invention is to provide a floor fan as the integral framework for a handtruck for the floor fan, the floor fan handtruck providing a carrier structure for miscellaneous equipment.

Another object of this invention is to provide a trailer system for attaching a second floor fan handtruck to the first floor fan handtruck to enable the operator to transport more than one floor fan handtruck from place to place.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
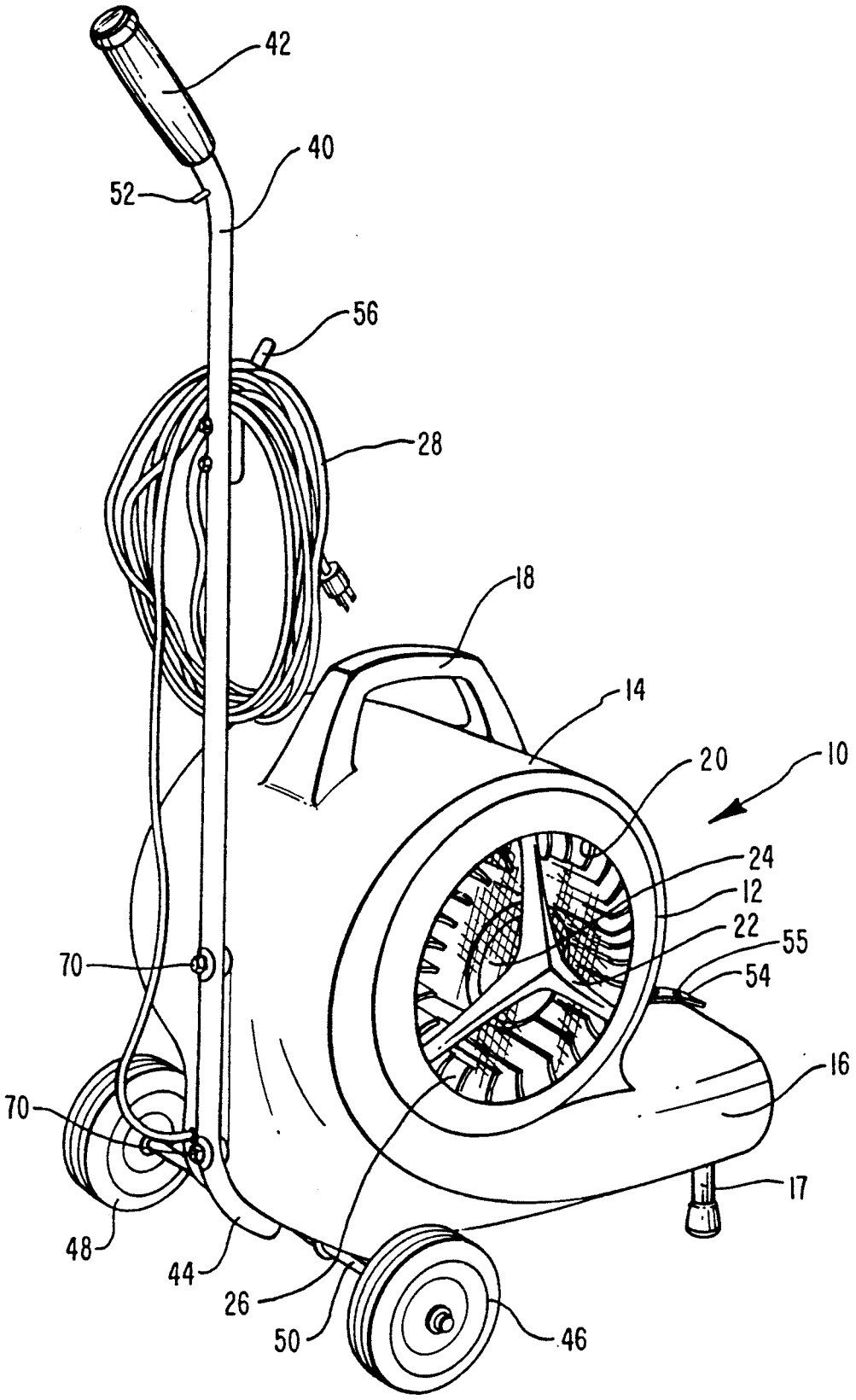
FIG. 1 is a perspective view of the novel floor fan handtruck of this invention.

The invention is best understood by reference to the drawing wherein like parts are designated by like numerals throughout in conjunction with the following description.

GENERAL DISCUSSION

This invention uniquely combines the wheels and handle of a handtruck with the body of a floor fan to create a novel handtruck apparatus and method for transporting one or more floor fans from place to place. Advantageously, the body of the floor fan provides the essential framework for the floor fan handtruck. The handle of the floor fan handtruck extends an incremental distance below the body of the floor fan where it is formed into a stair skid structure for keeping the basal portion of the floor fan as well as the handle from catching on a corner of a stair step. The upper end of the handle includes a hitch pin to allow one floor fan handtruck to be releasably coupled with a second floor fan handtruck and towed thereby. The handle also provides a transportation and storage site for electrical cords as well as safety cones.

The upright handle portion of the floor fan handtruck provides an additional safety feature in that it stands above the floor fan more nearly within the normal visual range of a pedestrian. Accordingly, the presence of the upright handle, especially with a safety cone mounted thereon, will substantially enhance the warning capability of the handle to alert others to the presence of the floor fan. These additional safety/warning features are especially important in light of the every-increasing litigious environment in this country.

The incorporation of the body or housing of the floor fan into a portion of the structural framework of the handtruck saves material, weight, and cost. Further, the presence of the handle and set of wheels does not interfere with the use of the conventional carrying handle on the floor fan. The handle, wheels, and floor fan housing, in effect, combine to create the novel floor fan handtruck of this invention.

DETAILED DESCRIPTION

Referring now to FIG. 1, the novel floor fan handtruck of this invention is shown generally at 10 and includes a floor fan 12 having a housing 14 that serves as the structural framework for floor fan handtruck 10. Housing 14 is mounted on a pair of wheels, wheels 46 and 48, with a handle 40 attached to the rear of housing 14. Floor fan 12 is a conventional floor fan having a discharge chute 16 extending tangentially outwardly from the lower portion of housing 14. Housing 14 includes an integral carrying handle 18 formed as an extension of housing 14. Housing 14 includes an inlet 20 to provide the air intake to floor fan 12. Air received through inlet 20 is discharged through discharge chute 16 by a squirrel cage fan 26 driven by an electric motor 24. Electric motor 24 is supported by motor support 22. Electrical power to electric motor 24 is supplied through an electrical cord 28. A switch (not shown) controls the speed of electric motor 24. Floor fan 12 is specifically designed to rest on the floor and blow a stream of air across the floor. The outer end of discharge chute 16 is supported by a pair of extensible supports, only one of which is shown herein as support 17. Raising or lowering the end of discharge chute 16 by extending or retracting support 17 adjusts the angular orientation of the air stream discharged from discharge chute 16 in relation to the floor surface.

Handle 40 is configured from a length of tubular stock. Handle 40 is curved inwardly at its lower end to create a stair skid 44 and is curved outwardly at its upper end to receive thereon a handgrip 42. Stair skid 44 extends incrementally beyond an imaginary cylindrical surface extending between the outer surface of wheels 46 and 48 so as to preclude the lower corner of housing 14 from contacting and/or catching on the edge of a stair step (not shown). The lowermost end of stair skid 44 curves inwardly into the foregoing imaginary cylindrical surface defined by wheels 46 and 48 where it is thereby protected from contacting the stair step since wheels 46 and 48 contact the same thereby shielding the lower end of stair skid 44 against contact and/or catching. Handgrip 42 is configured as a conventional handgrip and provides a convenient, safe, hand grasping surface to allow the user (not shown) to pull floor fan handtruck 10 from place to place. Handgrip 42 is also fabricated from an orange-colored, synthetic sponge material for both comfort and improved visibility for safety reasons.

Figure 3:
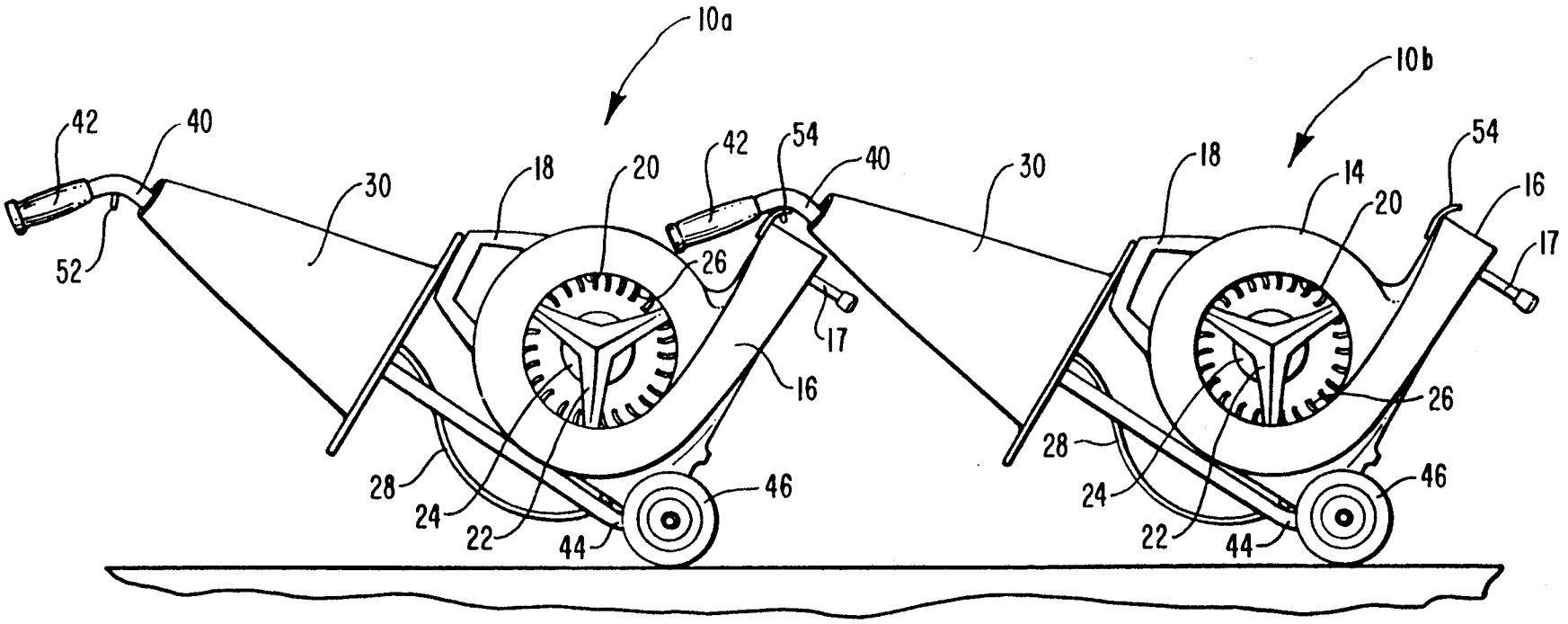
FIG. 3 is a side elevation of two floor fan handtrucks shown releasably coupled together for trailering.

A hitch pin 52 is mounted to handle 40 adjacent hand grip 42 and provides a convenient mechanism for releasably interlinking one floor fan handtruck 10 to another as shown more fully in FIG. 3. In particular, a hitch plate 54 is mounted at the upper, front center of discharge chute 16 and includes a hole 55 therein for receiving hitch pin 52. Hitch plate 54 is configured with an angular offset that is designed to correspond to the angular orientation of handle 40 when floor fan handtruck 10 is interconnected with a second floor fan handtruck 10 (FIG. 3). Importantly, the orientation of floor fan handtruck 10 to the position shown in FIG. 3 shifts the center of gravity so that the weight of floor fan handtruck 10 is downwardly on handle 40 to hold hitch pin 52 into engagement with hole 55 in hitch plate 54.

Figure 2:
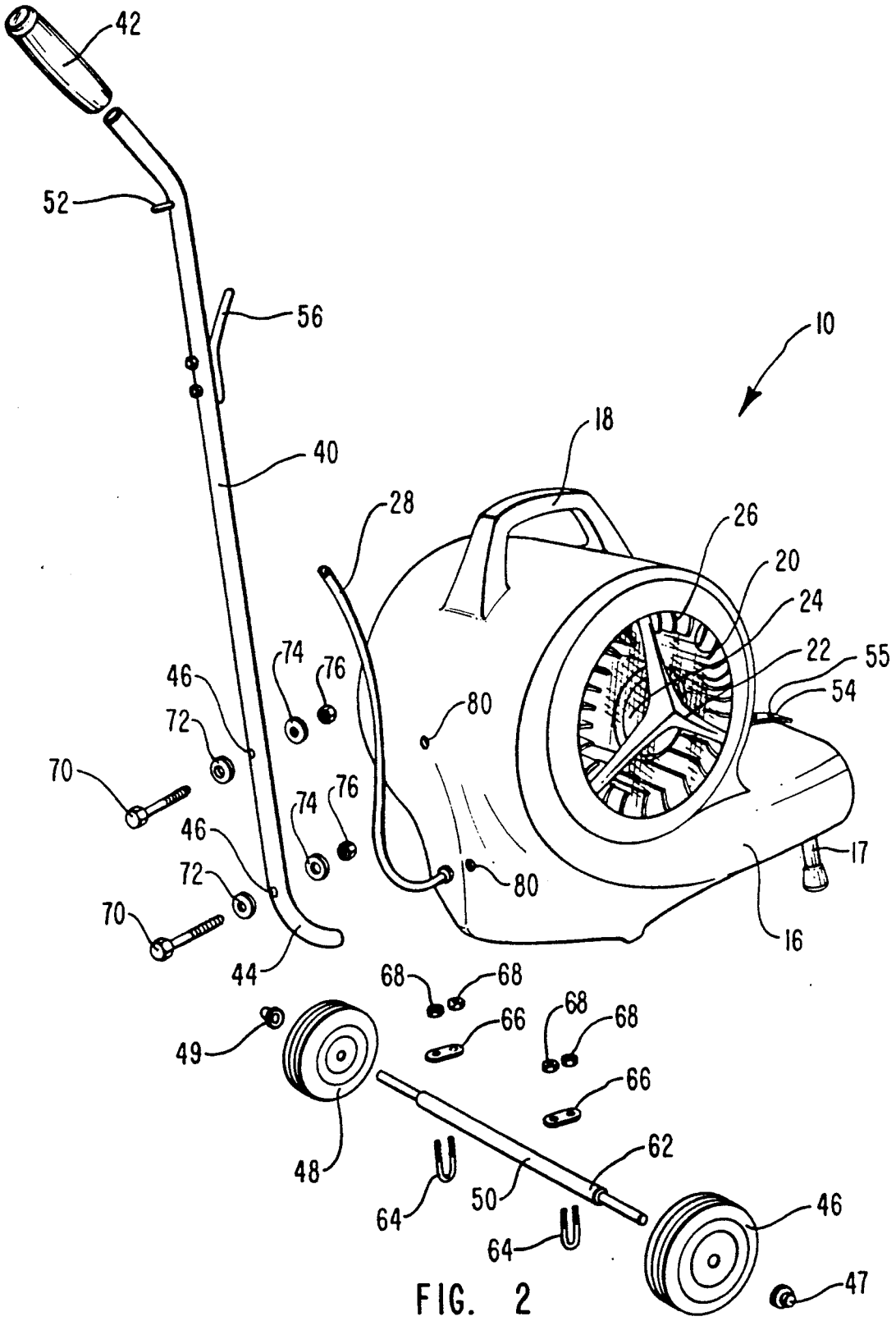
FIG. 2 is an exploded, perspective view of the floor fan handtruck shown in FIG. 1.

Referring now to FIG. 2, the relationship between the various components of floor fan handtruck 10 is more clearly shown. Wheels 46 and 48 are rotatably mounted to each end of an axle assembly 50. Axle assembly 50 includes a shaft 60 inside a spacer 62 so that wheels 46 and 48 are rotatably mounted to the ends of shaft 60 and are held in their spatial relationship by spacer 62. Lock caps 47 and 49 interlock wheels 46 and 48, respectively, to the respective ends of shaft 60.

Axle assembly 50 is bolted to the base of housing 44 by a pair of U bolts 64 which straddle axle assembly 50 and hold it securely to housing 14. A pair of washer plates 66 and lock nuts 68 complete the assembly of axle assembly 50 to housing 14. Actual attachment of axle assembly 50 to housing 14 is accomplished by drilling two sets of holes (not shown) in the base of housing 14. The threaded ends of U bolts 64 are inserted through these holes with U bolts 64 residing astraddle axle assembly 50. Washer plates 66 are then mounted to U bolts 62 inside housing 14 while lock nuts 68 are used to securely engage U bolts 62 and axle assembly 50 to housing 14.

Handle 40 is mounted generally vertically to housing 14 by a pair of bolts 70 which are received through a pair of corresponding holes 46 in handle 40 and holes 80 in housing 14. Washers 72 reside on the outer surface of handle 40 while washers 74 and lock nuts 76 are affixed to bolts 70 inside housing 14 to thereby securely engage handle 40 to housing 14. A cord hanger 56 and hitch pin 52 are mounted to handle 40.

Referring now to FIG. 3, a first floor fan handtruck **10*a* is shown tilted back to raise floor fan 12 upwardly and into a position where most of its weight is carried by wheel 46 and wheel 48 (FIGS. 1 and 2). A safety cone 30 is mounted to handle 40 to allow safety cone 30 to be more easily transported along with floor fan 12 from place to plate. In the orientation shown, the center of gravity of floor fan 12 is shifted across wheel 46 to create a downward force against handle 40 although most of the weight thereof is borne by wheel 46 and wheel 48 (FIGS. 1 and 2). Correspondingly, a second floor fan handtruck 10*b* is releasably coupled to floor fan handtruck 10*a* by the foregoing shift in the center of gravity holding hitch pin 52 into engagement with hitch plate 54. By this novel feature one or more floor fan handtrucks 10*b* can be trailed behind floor fan handtruck 10*a*. This allows the janitorial professional (not shown) to save considerable time and effort in transporting floor fans 12 and safety cones 30** from place to place.

Once in a place of use, floor fan handtruck 10 is returned to the vertical position and electrical cord 28 is plugged into a suitable electrical outlet. Safety cone 30 may be either left in place on handle 30 where it is a highly visible warning sign, or it can be removed therefrom and placed at any preselected position. Even when safety cone 30 is removed from handle 40, the presence of a vertically oriented handle 40 standing upright from floor fan 12 serves as an additional safety feature in that it will draw attention to the presence of floor fan 12 by being in a position closer to eye level. Visual attention is also attracted by handgrip 42.

The Method

The method of this invention is practiced by selecting a floor fan 12 and mounting thereto a pair of wheels, wheels 46 and 48, along with a handle 40. In effect, housing 14 of floor fan 12 becomes part of the structural framework to floor fan handtruck 10. U bolts 64 securely engage axle assembly 50 to the bottom of housing 14 while lock caps 47 and 49 secure wheels 46 and 48, respectively, in rotatable relationship to the respective ends of shaft 60 of axle assembly 50.

Handle 40 is also bolted to housing 14 by bolts 70. The lower end of handle 40 is formed into stair skid 44 by being curved inwardly toward axle assembly 50. The curvilinear section of stair skid 44 is specifically designed to contact any stair steps (not shown) to preclude either the edge of housing 14 or a straight end (not shown) of handle 40 from engaging the same. This feature makes it easy for the janitorial professional (not shown) to rapidly and easily move floor fan handtruck 10 up and down stairs (not shown) while transporting floor fan 12 from place to place. Not only does such a feature render floor fan 12 easier to transport, but it is also considerably safer for the janitorial professional since he or she is not required to hand carry floor fan 12 from place to place or even up and down any stairs.

A second floor fan handtruck **10*b* is easily pulled behind the first floor fan handtruck 10*a* by the simple step of directing hitch pin 52 into engagement with hole 55 in hitch plate 54. The janitorial professional is thereby readily able to transport more than one floor fan 12 to the desired location. Cord hook 56 safely and conveniently holds electrical cord 28 coiled thereon while safety cone 30 is mounted thereover. In this manner, electrical cord 28, safety cone 30 and floor fan 12** are all combined together as a easily transportable unit.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A floor fan handtruck comprising:

a floor fan, said floor fan comprising a housing and a horizontal discharge chute extending tangentially outwardly from a lower portion of said housing;

a pair of wheels rotatably mounted to said housing of said floor fan; and a handle means mounted to said housing of said floor fan, said handle means comprising a single upright handle for providing leverage means for tilting said discharge chute of said floor fan upwardly into a position wherein said floor fan is supported by said wheels to allow said floor fan to be pulled by said handle with said wheels supporting said floor fan, said handle means comprising a first attachment means and said discharge chute of said floor fan comprising a second attachment means, said first attachment means releasably attaching a first floor fan handtruck to said second attachment means on a second floor fan handtruck.

2. The floor fan handtruck defined in claim 1 wherein said handle means comprises a rack for carrying at least one safety cone telescopically mounted over said single upright handle.

3. The floor fan handtruck defined in claim 1 wherein said handle means comprises a hanger for holding an electric cord for said floor fan, said hanger comprising a single hook for holding a coil of said electric cord.

4. A floor fan handtruck comprising:

a floor fan, said floor fan comprising a housing and a horizontal discharge chute extending tangentially outwardly from a lower portion of said housing;

a pair of wheels rotatably mounted to said housing of said floor fan; and a handle means mounted to said housing of said floor fan, said handle means comprising a single upright handle for providing leverage means for tilting said discharge chute of said floor fan upwardly into a position wherein said floor fan is supported by said wheels to allow said floor fan to be pulled by said handle with said wheels supporting said floor fan, said handle means comprising a stair skid formed as a curvilinear extension of said single upright handle, said curvilinear extension extending incrementally below said floor fan.

5. A floor fan handtruck comprising:

a floor fan, said floor fan comprising an external housing having a front and a back, and a discharge chute extending from a lower portion of said front of said external housing;

a handle affixed to said back of said external housing, said handle extending vertically above said external housing;

said handle comprising a first attachment means and said discharge chute comprising a second attachment means, said first attachment means and said second attachment means releasably attaching a first floor fan handtruck to a second floor fan handtruck;

a stair skid formed as an integral part of said handle and extending below said external housing; and a pair of wheels mounted to said external housing to allow said floor fan to be rolled about on said wheels when said handle is pulled out of the vertical position to raise said discharge chute and place said floor fan over said wheels, said external housing thereby comprising a framework for a handtruck in combination with said handle and said wheels.

6. The floor fan handtruck defined in claim 5 wherein said handle comprises a storage rack for a safety cone, said handle comprising a single upright handle member to telescopically receive said safety cone.

7. The floor fan handtruck defined in claim 6 wherein said handle comprises a single storage hook for a coil of electric cord, said safety cone telescopically enclosing said storage hook and said coil when said safety cone is mounted on said handle.

8. A method for forming a floor fan handtruck using the floor fan as part of the framework for the handtruck comprising the steps of:

obtaining a floor fan, said floor fan having an external housing and a discharge chute extending from a lower portion of said external housing;

securing a hitch plate to said discharge chute;

mounting a pair of wheels to said external housing at a position opposite said discharge chute, said wheels supporting said floor fan when said floor fan is tilted lifting said discharge chute;

affixing a handle to said floor fan, said handle extending vertically from said external housing opposite said discharge chute, said handle cooperating with said external housing and said wheels thereby forming said floor fan handtruck with said external housing forming a part of said framework; and attaching a hitch pin to said handle, said hitch plate of a first floor fan handtruck releasably engaging a hitch pin of a second floor fan handtruck thereby adapting said first floor fan handtruck to pulling a second floor fan handtruck.

9. The method defined in claim 8 wherein said affixing step comprises forming a stair skid on the lower end of said handle, said stair skid comprising below said floor fan.

10. The method defined in claim 8 wherein said affixing step comprises telescopically mounting a safety cone over said handle, said handle thereby storing and transporting said safety cone.

11. The method defined in claim 8 wherein said affixing step comprises placing a single storage hook on said handle, said single storage hook storing an electric cord for said floor fan by providing a hanger for a coil of said electric cord.

* * * * *